US005340712A

United States Patent [19]

Dunn et al.

[11] Patent Number: 5,340,712

[45] Date of Patent: Aug. 23, 1994

[54] ANTIFOGGANTS FOR PHOTOTHERMOGRAPHIC ARTICLES

[75] Inventors: Susan H. Dunn, Lake Elmo, Minn.; Mark P. Kirk, Savona, Italy; Roger A. Mader, Stillwater; Terence D. Spawn, Maplewood, both of Minn.

[73] Assignee: Minnesota Mining and Manufacturing Company, St. Paul, Minn.

[21] Appl. No.: 51,085

[22] Filed: Apr. 21, 1993

[51] Int. Cl.[5] ..... G03C 1/498

[52] U.S. Cl. ..... 430/619; 430/600; 430/613; 430/617

[58] Field of Search ..... 430/619, 617, 600, 613

[56] References Cited

U.S. PATENT DOCUMENTS 3,874,946 4/1975 Costa et al. ..... 96/48
4,215,937 7/1980 Akashi et al. ..... 430/613
4,459,350 7/1984 Przezdziecki ..... 430/353
4,543,309 9/1985 Hirabayashi et al. ..... 430/619
4,546,075 10/1985 Kitaguchi et al. ..... 430/617

FOREIGN PATENT DOCUMENTS 61-93451 5/1986 Japan .

*Primary Examiner*—Thorl Chea
*Attorney, Agent, or Firm*—Gary L. Griswold; Walter N. Kirn; Mark A. Litman

[57] ABSTRACT

Radiation sensitive thermally developable imaging elements comprise:

(a) photosensitive silver halide,
(b) light insensitive silver salt oxidizing agent,
(c) reducing agent for silver ions, and
(d) an antifoggant compound comprising s-triazines having at least one tribromomethyl substituent. The antifoggants are effective in reducing spurious background image densities.

7 Claims, No Drawings

ANTIFOGGANTS FOR PHOTOTHERMOGRAPHIC ARTICLES

FIELD OF THE INVENTION

This invention relates to photothermographic materials and in particular to antifoggants in photothermographic silver-containing materials.

BACKGROUND OF THE INVENTION

Silver halide containing photothermographic imaging materials processed with heat, and without liquid development have been known in the art for many years. These materials generally comprise a support having thereon a photographic light-sensitive silver halide, a light-insensitive organic silver salt, and a reducing agent for the organic silver salt.

The light-sensitive silver halide is in catalytic proximity to the light-insensitive organic silver salt so that the latent image, formed by irradiation of the silver halide, serves as a catalyst nucleus for the oxidation-reduction reaction of the organic silver salt with the reducing agent when the emulsion is heated above about 80° C. Such media are described, for example, in U.S. Pat. Nos. 3,457,075, 3,839,049, and 4,260,677. The silver halide may also be generated in the media by a preheating step in which halide ion is released to form silver halide.

A variety of ingredients may be added to these basic components to enhance performance. For example, toning agents may be incorporated to improve the color of the silver image of the photothermographic emulsions, as described in U.S. Pat. Nos. 3,846,136; 3,994,732 and 4,021,249. Various methods to produce dye images and multicolor images with photographic color couplers and leuco dyes are known and described in U.S. Pat. Nos. 4,022,617; 3,531,286; 3,180,731; 3,761,270; 4,460,681; 4,883,747 and Research Disclosure, March 1989, item 29963.

Common problems that exist with photothermographic systems are fog and post-processing instability of the image. The photoactive silver halide still present in the developed image may continue to catalyze printout of metallic silver during room light handling. Thus, there exists a need for stabilization of the unreacted silver halide. The addition of separate post-processing image stabilizers have been used to impart post-processing stability. Most often these are sulfur containing compounds such as mercaptans, thiones, and thioethers as described in Research Disclosure, June 1978, item 17029. U.S. Pat. Nos. 4,245,033, 4,837,141 and 4,451,561 describe sulfur compounds that are development restrainers for photothermographic systems. Mesoionic 1,2,4-triazolium-3-thiolates as fixing agents and silver halide stabilizers are described in U.S. Pat. No. 4,378,424. Substituted 5-mercapto-1,2,4-triazoles such as 3-amino-5-benzothio-1,2,4-triazole as post-processing stabilizers are described in U.S. Pat. Nos. 4,128,557, 4,137,079, 4,138,265, and Research Disclosure, May 1978, items 16977 and 16979.

Silver halide photothermographic imaging materials, often referred to as "dry silver" compositions because no liquid development is necessary to produce the final image, have been known in the art for many years. These imaging materials basically comprise a light insensitive, reducible silver source, a light sensitive material which generates silver when irradiated and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of the silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed and U.S. Pat. No. 4,260,677 discloses the use of complexes of inorganic or organic silver salts as image source materials.

In both photographic and photothermographic emulsions, exposure of the silver halide to light produces small clusters of silver atoms. The imagewise distribution of these clusters is known in the art as the latent image. This latent image generally is not visible by ordinary means and the light sensitive article must be further processed in order to produce a visual image. The visual image is produced by the catalytic reduction of silver ions which are in catalytic proximity to the specks of the latent image.

U.S. Pat. No. 4,460,681 discloses a color photothermographic element in which color forming layers are separated by barrier layers to prevent migration of components between layers which would reduce the color separation.

U.S. Pat. No. 4,594,307 discloses a thermal diffusion transfer photothermographic element in which individual color sheets are used to provide colors. Multiple color images are formed by the use of multiple sheets of different colors.

Photothermographic emulsions, in a manner similar to photographic emulsions and other light sensitive systems, tend to suffer from fog. This spurious image density which appears in non-developmentally sensitized areas of the element. This is often reported in sensitometric results as $D_{min}$. This problem is also related to certain stability factors in the photosensitive elements where fog increases upon storage of the photosensitive element.

U.S. Pat. No. 4,212,937 describes the use of a nitrogen-containing organic base in combination with a halogen molecule or an organic haloamide to improve storage stability and sensitivity.

Japanese Patent Kokai JA 61-129642 published Jun. 17, 1986 describes the use of halogenated compounds to reduce fog in color-forming photothermographic emulsions. These compounds include acetophenones including phenyl-(alpha,alpha-dibromobenzyl)-ketone.

U.S. Pat. No. 3,589,903 describes the use of small amounts of mercuric ion in photothermographic silver halide emulsions to improve speed and aging stability.

U.S. Pat. No. 4,784,939 describes the use of benzoyl acid compounds of a defined formula to reduce fog and to improve the storage stability of silver halide photothermographic emulsions. The addition of halogen molecules to the emulsions are also described as improving fog and stability.

U.S. Pat. No. 3,874,946 describes the use of 2,4-bis(-tribromomethyl) substituted s-triazines with a 1-6 carbon atom alkyl substitution on the 6-position. The 6-methyl compound is exemplified.

SUMMARY OF THE INVENTION

This invention relates to photothermographic articles comprising a photothermographic composition coated on a substrate wherein the photothermographic composition comprises a photographic silver salt, an organic silver salt, and a reducing agent for the organic silver salt, and an antifoggant comprising a triazine (preferably an s-triazine) having at least one tribromomethyl substituent.

Where the term group is used in describing substituents, substitution is anticipated on the substituent for example, alkyl group includes ether groups (e.g., $CH_3—CH_2—CH_2—O—CH_2—$), haloalkyls, nitroalkyls, carboxyalkyl, hydroalkyls, sulfoalkyls, etc. while the term alkyl includes only hydrocarbons. Substituents which react with active ingredients, such as very strongly electrophilic or oxidizing substituents, would of course be excluded as not being inert or harmless.

DETAILED DESCRIPTION OF THE INVENTION

Photothermographic articles of the present invention comprise a photothermographic composition coated on a substrate wherein the photothermographic construction comprises a photographic silver salt, an organic silver salt, a reducing agent for the organic silver salt, and an antifoggant comprising a triazine having at least one tribromomethyl substituent.

The s-triazine compounds useful in the practice of the present invention may be generally described as having a nucleus of the formula:

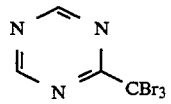

and preferably a nucleus of the formula:

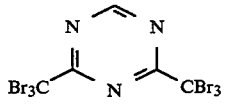

A wide variety of compounds having these nuclei may be used in the practice of the present invention. The bromine content of the compounds is preferably at least 30% by weight of the compounds, more preferably at least 40% and most preferably at least 60% by total weight of the antifoggant compound. Preferably the triazines are 1,3,5-triazine. Representative triazines include:

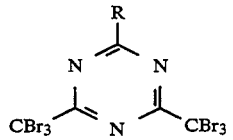

wherein R is $—NR^1R^2$ where $R^1$ and $R^2$ are selected from H, alkyl group of 1 to 20 carbon atoms (including cycloalkyl), and aryl group of 1 to 20 carbon atoms, or $R^1$ and $R^2$ may form a heterocyclic ring group (e.g., of 5, 6 or 7 ring atoms of C, S, N and O) inclusive of the N atom of $—NR^1R^2$.

R is preferably selected from the group consisting of

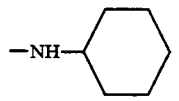

and six membered heterocyclic rings joined directly to the triazine through a nitrogen atom of the heterocyclic ring group (e.g., piperidino groups), Compound 1, 2,4,6-tris-(tribromomethyl)1,3,5-triazine or s-triazine (as prepared according to F. C. Schaefer and J. H. Ross, J.O.C. 29 (1964) p. 1527)

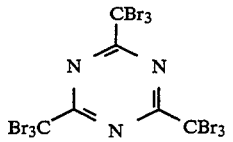

Compound 2, piperidino-4,6-bis-(tribromomethyl)1,3,5-triazine

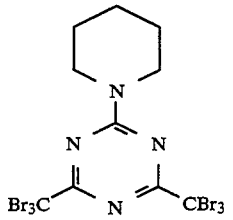

Compound 3, 2-(4-hydroxypiperidino)-4,6-bis(tribromomethyl)-s-triazine

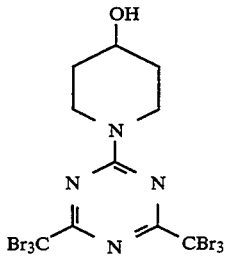

(Both Compound 2 and Compound 3 were prepared by the reaction of Compound 1 with piperidine (0.01 moles/0.006 moles Compound 1) or 4-hydroxypiperidine (1/1 mole ratio with Compound 1) in tetrahydrofuran (30 ml) at room temperature. After a ten minute reaction time, dilution with water (100 ml) resulted in an oil which quickly solidified. The resulting solids were filtered and recrystallized from acetonitrile.

Compound 4, N,N'-[2-4,6-bis(tribromomethyl)-s-triazinyl]-1,4-diaminocyclohexane

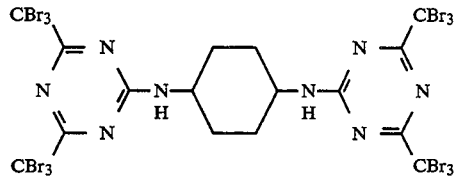

This was prepared by reaction of 0.006 mole Compound 1 with 0.003 moles 1,4-diaminocyclohexane for twenty minutes at room temperature in 30 ml of tetrahydrofuran. The solution was diluted with 100 ml water after the reaction was complete, the solidified oil filtered, triturated with boiling acetonitrile, cooled to room temperature and collected by filtration.

Compound 5, N-N'-[2-4,6-bis(tribromomethyl)-s-triazine]-1,3-di(4-piperidino)propane

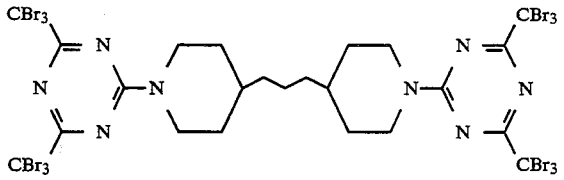

N,N'-[2-4,6-bis(tribromomethyl)-s-triazinyl]1,3-di(4-piperidino)propane (Compound 5) was prepared by adding a solution of 1,3-di(4-piperidino)propane (42 g) dissolved in 200 ml of THF, rapidly to a stirred solution of 2,4,6-tris(tribromomethyl)-s-triazine (333 g) dissolved in 400 ml of THF. The reaction flask was cooled with an ice bath to maintain the reaction temperature near room temperature. The resulting cloudy solution was then diluted with 1 liter of water. Two layers resulted. The upper layer was aspirated off, and a second 1 liter portion of water was added. Again after brief stirring, the layers separated and the upper water layer was removed. Finally, 1.5 liters of acetonitrile was added and the mixture was heated on a steam bath with stirring until the oil formed a nice off-white solid. The solid was collected from the warm suspension by filtration to obtain 139.5 g.

In photothermographic articles of the present invention the layer(s) that contain the photographic silver salt are referred to herein as emulsion layer(s). According to the present invention the triazine antifoggant is added either to one or more emulsion layers or to a layer or layers adjacent to one or more emulsion layers. Layers that are adjacent to emulsion layers may be for example, primer layers, image-receiving layers, interlayers, opacifying layers, antihalation layer, barrier layer, auxiliary layers, etc.

Photothermographic articles of the invention may contain other antifoggants in combination with the compounds of the invention, as well as other additives in combination with the compound of the invention such as shelf-life stabilizers, toners, development accelerators and other image modifying agents.

The amounts of the antifoggants of the present invention that are added to the emulsion layer according to the present invention may be varied depending upon the particular compound used and upon the type of emulsion layer (i.e., black and white or color). However, the ingredients are preferably added in an amount of 0.001 to 10.0 mol, and more preferably from 0.01 to 5.0 mol per mol of silver halide in the emulsion layer.

The photothermographic dry silver emulsions of this invention may be constructed of one or more layers on a substrate. Single layer constructions must contain the silver source material, the silver halide, the developer and binder as well as optional additional materials such as toners, coating aids, and other adjuvants. Two-layer constructions must contain the silver source and silver halide in one emulsion layer (usually the layer adjacent to the substrate) and some of the other ingredients in the second layer or both layers, although two layer constructions comprising a single emulsion layer containing all the ingredients and a protective topcoat are envisioned. Multicolor photothermographic dry silver constructions may contain sets of these bilayers for each color, or they may contain all ingredients within a single layer as described in U.S. Pat. No. 4,708,928. In the case of multilayer multicolor photothermographic articles the various emulsion layers are generally maintained distinct from each other by the use of functional or non-functional barrier layers between the various photosensitive layers as described in U.S. Pat. No. 4,460,681.

While not necessary for practice of the present invention, it may be advantageous to add mercury (II) salts to the emulsion layer(s) as an antifoggant. Preferred mercury (II) salts for this purpose are mercuric acetate and mercuric bromide. It is preferred that there be less than 0.005 moles mercury per mole of silver halide, and preferably that the emulsion be free of mercury.

The light sensitive silver halide used in the present invention may typically be employed in a range of 0.75 to 25 mol percent and, preferably, from 2 to 20 mol percent of organic silver salt.

The silver halide may be any photosensitive silver halide such as silver bromide, silver iodide, silver chloride, silver bromoiodide, silver chlorobromoiodide, silver chlorobromide, etc. The silver halide may be in any form which is photosensitive including, but not limited to cubic, orthorhombic, tabular, tetrahedral, etc., and may have epitaxial growth of crystals thereon.

The silver halide used in the present invention may be employed without modification. However, it may be chemically sensitized with a chemical sensitizing agent such as a compound containing sulfur, selenium or tellurium etc., or a compound containing gold, platinum, palladium, rhodium or iridium, etc., a reducing agent such as a tin halide, etc., or a combination thereof. The details of these procedures are described in T. N. James "The Theory of the Photographic Process", Fourth Edition, Chapter 5, pages 149 to 169.

The silver halide may be added to the emulsion layer in any fashion which places it in catalytic proximity to the silver source. Silver halide and the organic silver salt which are separately formed or "preformed" in a binder can be mixed prior to use to prepare a coating solution, but it is also effective to blend both of them in a ball mill for a long period of time. Further, it is effective to use a process which comprises adding a halogen-containing compound in the organic silver salt prepared to partially convert the silver of the organic silver salt to silver halide.

Methods of preparing these silver halide and organic silver salts and manners of blending them are known in the art and described in Research Disclosure, June 1978, item 17029, and U.S. Pat. No. 3,700,458.

The use of preformed silver halide emulsions of this invention can be unwashed or washed to remove soluble salts. In the latter case the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341. The silver halide grains may have any crystalline habit including, but not limited to cubic, tetrahedral, orthorhombic, tabular, laminar, platelet, etc.

The organic silver salt may be any organic material which contains a reducible source of silver ions. Silver salts of organic acids, particularly long chain (10 to 30 preferably 15 to 28 carbon atoms) fatty carboxylic acids are preferred. Complexes of organic or inorganic silver salts wherein the ligand has a gross stability constant between 4.0 and 10.0 are also desirable. The silver source material should preferably constitute from about 5 to 30 percent by weight of the imaging layer.

The organic silver salt which can be used in the present invention is a silver salt which is comparatively stable to light, but forms a silver image when heated to 80° C. or higher in the presence of an exposed photocatalyst (such as photographic silver halide) and a reducing agent.

Preferred organic silver salts include silver salts of organic compounds having a carboxy group. Non-limiting examples thereof include silver salts of an aliphatic carboxylic acid and a silver salt of an aromatic carboxylic acid. Preferred examples of the silver salts of aliphatic carboxylic acids include silver behenate, silver stearate, silver oleate, silver laurate, silver caproate, silver myristate, silver palmitate, silver maleate, silver fumarate, silver tartrate, silver linoleate, silver butyrate and silver camphorate, mixtures thereof, etc. Silver salts with a halogen atom or a hydroxyl on the aliphatic carboxylic acid can also be effectively used. Preferred examples of the silver salts of aromatic carboxylic acids and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663, etc.

Silver salts of compounds containing mercapto or thione groups and derivatives thereof can also be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)-benzothiazole, a silver salt of thioglycolic acid such as a silver salt of an S-alkyl thioglycolic acid (wherein the alkyl group has from 12 to 22 carbon atoms), a silver salt of a dithiocarboxylic acid such as a silver salt of dithioacetic acid, a silver salt of a thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 2-mercaptothiazole derivative such as a silver salt of 3-amino-5-benzylthio-1,2,4-thiazole, a silver salt of thione compound such as a silver salt of 3-(2-carboxyethyl)-4-methyl-4-thiazoline-2-thione as disclosed in U.S. Pat. No. 3,301,678.

Furthermore, a silver salt of a compound containing an imino group may be used. Preferred examples of these compounds include silver salts of benzothiazole and derivatives thereof, for example, silver salts of benzothiazoles such as silver methylbenzotriazolate, etc., silver salt of halogen-substituted benzotriazoles, such as silver 5-chlorobenzotriazolate, etc., silver salts of carboimidobenzotriazole, etc., silver salt of 1,2,4-triazoles or 1-H-tetrazoles as described in U.S. Pat. No. 4,220,709, silver salts of imidazoles and imidazole derivatives, and the like. Various silver acetylide compounds can also be used, for instance, as described in U.S. Pat. Nos. 4,761,361 and 4,775,613.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about four or five percent of free behenic acid and analyzing about 25.2 percent silver may be used.

The method used for making silver soap dispersions is well known in the art and is disclosed in Research Disclosure, April 1983, item 22812, Research Disclosure, October 1983, item 23419 and U.S. Pat. No. 3,985,565.

The light-sensitive silver halides may be advantageously spectrally sensitized with various known dyes including cyanine, merocyanine, styryl, hemicyanine, oxonol, hemioxonol and xanthene dyes. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Practically, the sensitizing dyes to be used in the present invention may be properly selected from known dyes such as those described in U.S. Pat. Nos. 3,761,279, 3,719,495, and 3,877,943, British Pat. Nos. 1,466,201, 1,469,117 and 1,422,057, and can be located in the vicinity of the photocatalyst according to known methods. Spectral sensitizing dyes may be typically used in amounts of about $10^{-4}$ mol to about 1 mol per 1 mol of silver halide.

The reducing agent for the organic silver salt may be any material, preferably organic material, that can reduce silver ion to metallic silver. Conventional photographic developers such as phenidone, hydroquinones, and catechol are useful but hindered phenol reducing agents are preferred. The reducing agent should be present as 1 to 10 percent by weight of the imaging layer. In multilayer constructions, if the reducing agent is added to a layer other than an emulsion layer, slightly higher proportions, of from about 2 to 15 percent tend to be more desirable.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydrazine); a combination of aliphatic carboxylic acid aryl hydrazides and ascorbic acid, such as 2,2'-bis(hydroxymethyl)propionyl-β-phenylhydrazide in combination with ascorbic acid; a combination of polyhydroxybenzene and hydroxylamine, a reductone and/or a hydrazine (e.g., a combination of hydroquinone and bis(ethoxyethyl)hydroxylamine, piperidinohexose reductone or formyl-4-methylphenylhydrazine); hydroxamic acids such as phenylhydroxamic acid, p-hydroxyphenylhydroxamic acid, and β-alaninehydroxamic acid; a combination of azines and sulfonamidophenols, (e.g., phenothiazine and 2,6-dichloro-4-benzenesulfonamidophenol); α-cyanophenylacetic acid derivatives such as ethyl-α-cyano-2-methylphenylacetate, ethyl α-cyanophenylacetate; bis-β-naphthols as illustrated by 2,2'-dihydroxyl-1-binaphthyl, 6,6'-dibromo-2,2'-dihydroxy-1,1'-binaphthyl, and bis(2-hydroxy-1-naphthyl)methane; a combination of bis-β-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydropiperidonehexose reductone; sulfonamido-phenol reducing agents such as 2,6-dichloro-4-benzensulfonamidophenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols (e.g., bis(2-hydroxy-3-t-butyl-5-methylphenyl)methane, 2,2-bis(4-hydroxy-3-methylphenyl)propane, 4,4-ethylidene-bis(2-t-butyl-6-methylphenol), and 2,2-bis(3,5-dimethyl-4-hydroxyphenyl)propane); ascorbic acid derivatives (e.g., 1-ascorbyl palmitate, ascorbyl stearate); and unsaturated aldehydes and ketones, such as benzil and biacetyl; 3-pyrazolidones and certain indane-1,3-diones.

In addition to the aforementioned ingredients it may be advantageous to include additives known as "toners" that improve the image. Toner materials may be present, for example, in amounts from 0.1 to 10 percent by weight of all silver bearing components. Toners are well known materials in the photothermographic art as shown in U.S. Pat. Nos. 3,080,254; 3,847,612 and 4,123,282.

Examples of toners include phthalimide and N-hydroxyphthalimide; cyclic imides such as succinimide, pyrazoline-5-ones, and a quinazolinone, 3-phenyl-2-pyrazoline-5-one, 1-phenylurazole, quinazoline, and 2,4-thiazolidinedione; naphthalimides (e.g., N-hydroxy-1,8-naphthalimide); cobalt complexes (e.g., cobaltic hexammine trifluoroacetate); mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, (e.g., (N, N-dimethylaminomethyl)phthalimide, and N,N-(dimethylaminomethyl)naphthalene-2,3-dicarboximide); and a combination of blocked pyrazoles, isothiuronium derivatives and certain photobleaching agents (e.g., a combination of N,N'-hexamethylene bis(1-carbamoyl-3,5-dimethylpyrazole), 1,8-(3,6-diazaoctane)bis(isothiuronium trifluoroacetate) and 2-(tribromomethylsulfonyl)benzothiazole); and merocyanine dyes such as 3-ethyl-5[(3-ethyl-2-benzothiazolinylidene)-1-methylethylidene]-2-thio-2,4-oxazolidinedione; phthalazinone and phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus sulfinic acid derivatives (e.g., phthalic acid, 4-methylphthalic acid, 4-nitrophthalic acid, and tetrachlorophthalic anhydride); quinazolinediones, benzoxazine or naphthoxazine derivatives; rhodium complexes functioning not only as tone modifiers, but also as sources of halide ion for silver halide formation in situ, such as ammonium hexachlororhodate (III), rhodium bromide, rhodium nitrate and potassium hexachlororhodate (III); inorganic peroxides and persulfates (e.g., ammonium peroxydisulfate and hydrogen peroxide); benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asymmetric triazines (e.g., 2,4-dihydroxypyrimidine, 2-hydroxy-4-aminopyrimidine), azauracils, and tetrazapentalene derivatives (e.g., 3,6-dimercapto-1,4-diphenyl-1H,4H-2,3α,5,6α-tetrazapentalene, and 1,4-di(o-chlorophenyl)-3,6-dimercapto-1H,4H-2,3α,5,6α-tetrazapentalene).

A number of methods are known in the art for obtaining color images with dry silver systems including: a combination of silver benzotriazole, well known magenta, yellow and cyan dye-forming couplers, aminophenol developing agents, a base release agent such as guanidinium trichloroacetate and silver bromide in poly(vinyl butyral) as described in U.S. Pat. Nos. 4,847,188 and 5,064,742; preformed dye release systems such as those described in U.S. Pat. No. 4,678,739; a combination of silver bromoiodide, sulfonamidophenol reducing agent, silver behenate, poly(vinyl butyral), an amine such as n-octadecylamine and 2-equivalent or 4-equivalent cyan, magenta or yellow dye-forming couplers; leuco dye bases which oxidize to form a dye image (e.g., Malachite Green, Crystal Violet and pararosaniline); a combination of in situ silver halide, silver behenate, 3-methyl-1-phenylpyrazolone and N,N'-dimethyl-p-phenylenediamine hydrochloride; incorporating phenolic leuco dye reducing agents such as 2(3,5-di-(t-butyl)-4-hydroxyphenyl)-4,5-diphenylimidazole, and bis(3,5-di-(t-butyl)-4-hydroxyphenyl)phenylmethane, incorporating azomethine dyes or azo dye reducing agents; silver dye bleach processes (for example, an element comprising silver behenate, behenic acid, poly(vinyl butyral), poly(vinyl-butyral)peptized silver bromoiodide emulsion, 2,6-dichloro-4-benzenesulfonamidophenol, 1,8-(3,6-diazaoctane)bis(isothiuronium-p-toluenesulfonate)and an azo dye can be exposed and heat processed to obtain a negative silver image with a uniform distribution of dye, then laminated to an acid activator sheet comprising polyacrylic acid, thiourea and p-toluenesulfonic acid and heated to obtain well defined positive dye images; and amines such as aminoacetanilide (yellow dye-forming), 3,3'-dimethoxybenzidine (blue dye-forming) or sulfanilide (magenta dye forming) that react with the oxidized form of incorporated reducing agents such as 2,6-dichloro-4-benzenesulfonamidophenol to form dye images. Neutral dye images can be obtained by the addition of amines such as behenylamine and p-anisidine.

Leuco dye oxidation in such silver halide systems for color formation is disclosed in U.S. Pat. Nos. 4,021,240, 4,374,821, 4,460,681 and 4,883,747.

Silver halide emulsions containing the antifoggants of this invention can be protected further against the additional production of fog and can be stabilized against loss of sensitivity during shelf storage. Suitable antifoggants, stabilizers, and stabilizer precursors which can be used alone or in combination, include thiazolium salts as described in U.S. Pat. Nos. 2,131,038 and 2,694,716; azaindenes as described in U.S. Pat. Nos. 2,886,437 and 2,444,605; mercury salts as described in U.S. Pat. No. 2,728,663; urazoles as described in U.S. Pat. No. 3,287,135; sulfocatechols as described in U.S. Pat. No. 3,235,652; oximes as described in British Pat. No. 623,448; nitrones; nitroindazoles; polyvalent metal salts as described in U.S. Pat. No. 2,839,405; thiouronium salts as described in U.S. Pat. No. 3,220,839; and palladium, platinum and gold salts described in U.S. Pat. Nos. 2,566,263 and 2,597,915; halogen-substituted organic compounds as described in U.S. Pat. Nos. 4,108,665 and 4,442,202; triazines as described in U.S. Pat. Nos. 4,128,557; 4,137,079; 4,138,265; and 4,459,350; and phosphorous compounds as described in U.S. Pat. No. 4,411,985.

Stabilized emulsions of the invention can contain plasticizers and lubricants such as polyalcohols (e.g., glycerin and diols of the type described in U.S. Pat. No. 2,960,404); fatty acids or esters such as those described in U.S. Pat. No. 2,588,765 and U.S. Pat. No. 3,121,060; and silicone resins such as those described in British Pat. No. 955,061.

The photothermographic elements of the present invention may include image dye stabilizers. Such image dye stabilizers are illustrated by British Pat. No. 1,326,889; U.S. Pat. Nos. 3,432,300; 3,698,909; 3,574,627; 3,573,050; 3,764,337 and 4,042,394.

Photothermographic elements containing emulsion layers stabilized according to the present invention can be used in photographic elements which contain light absorbing materials and filter dyes such as those described in U.S. Pat. Nos. 3,253,921; 2,274,782; 2,527,583 and 2,956,879. If desired, the dyes can be mordanted, for example, as described in U.S. Pat. No. 3,282,699.

Photothermographic elements containing emulsion layers stabilized as described herein can contain matting agents such as starch, titanium dioxide, zinc oxide, silica, polymeric beads including beads of the type described in U.S. Pat. No. 2,992,101 and U.S. Pat. No. 2,701,245.

Emulsions with antifoggants in accordance with this invention can be used in photothermographic elements which contain antistatic or conducting layers, such as layers that comprise soluble salts (e.g., chlorides, nitrates, etc.), evaporated metal layers, ionic polymers such as those described in U.S. Pat. Nos. 2,861,056 and 3,206,312 or insoluble inorganic salts such as those described in U.S. Pat. No. 3,428,451.

The binder may be selected from any of the well-known natural or synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The preferred photothermographic silver containing polymers are polyvinyl butyral, butyl ethyl cellulose, methacrylate copolymers, maleic anhydride ester copolymers, polystyrene, and butadiene-styrene copolymers.

Optionally, these polymers may be used in combinations of two or more thereof. Such a polymer is used in an amount sufficient to carry the components dispersed therein, that is, within the effective range of the action as the binder. The effective range can be appropriately determined by one skilled in the art. As a guide in the case of carrying at least an organic silver salt, it can be said that a preferable ratio of the binder to the organic silver salt ranges from 15:1 to 1:2, and particularly from 8:1 to 1:1.

Photothermographic emulsions containing an antifoggant according to the present invention may be coated on a wide variety of supports. Typical supports include polyester film, subbed polyester film, poly(ethylene terephthalate)film, cellulose nitrate film, cellulose ester film, poly(vinyl acetal) film, polycarbonate film and related or resinous materials, as well as glass, paper metal and the like. Typically, a flexible support is employed, especially a paper support, which may be partially acetylated or coated with baryta and/or an $\alpha$-olefin polymer, particularly a polymer of an $\alpha$-olefin containing 2 to 10 carbon atoms such as polyethylene, polypropylene, ethylene-butene copolymers and the like. Substrates may be transparent or opaque.

Substrates with a backside resistive heating layer may also be used in color photothermographic imaging systems such as shown in U.S. Pat. Nos. 4,460,681 and 4,374,921.

Photothermographic emulsions of this invention can be coated by various coating procedures including dip coating, air knife coating, curtain coating, or extrusion coating using hoppers of the type described in U.S. Pat. No. 2,681,294. If desired, two or more layers may be coated simultaneously by the procedures described in U.S. Pat. No. 2,761,791 and British Pat. No. 837,095.

Additional layers may be incorporated into photothermographic articles of the present invention such as dye receptive layers for receiving a mobile dye image, an opacifying layer when reflection prints are desired, a protective topcoat layer and a primer layer as is known in the photothermographic art. Additionally, it may be desirable in some instances to coat different emulsion layers on both sides of a transparent substrate, especially when it is desirable to isolate the imaging chemistries of the different emulsion layers.

The present invention will be illustrated in detail in the following examples, but the embodiment of the present invention is not limited thereto.

EXAMPLES 1-5

Five tribromomethyl substituted triazine compounds are exemplified in dry silver constructions according to the present invention. These compounds were added to the described topcoat formulation and coated over the described no-mercury silver trip. The topcoat was applied at 2.7 mils and dried at 185° F. (80° C.) for 3 minutes. It has been found that these constructions demonstrate excellent sensitometric properties over a wide range of development conditions when compared to the mercury formulation.

The photothermographic materials were exposed using an EGG xenon flash unit set at 10-3 seconds using a P-31 filter. These materials were processed under three separate development conditions to assure adequate processing latitude. (290° F. (142° C.)/3 seconds, 250° F. (120° C.)/6 seconds and 245° F. (117° C.)/12 seconds.) The material processed at 250° F. for 6 seconds was used in the evaluations for light stability and aging.

Post development light stability was evaluated using room conditions (75 footcandles) and the accelerated lightbox method of 1200 fc for 12 hours.

The accelerated incubation aging was conducted using a Blue M oven set at 120° F. (50° C.) and 50% RH with the samples evaluated weekly for up to one month.

| Topcoat Formulation | |
|---|---|
| Acetone | 416.6 mls |
| MEK (methyl ethyl ketone) | 205.0 mls |
| MeOH (methanol) | 83.9 mls |
| Cellulose Acetate | 27.0 gms |
| Syloid X-6000 (Silica) | 3.36 gms |
| PHZ (phthalazine) | 3.08 gms |
| 4MPA (4-methylphthalic acid) | 2.14 gms |
| TCPA (tetrachlorophthalic anhydride) | 1.27 gms |
| Compounds 1-5 | See Below |

The topcoat chemicals were mixed in a laboratory blender and aged overnight with the specific antifoggant added the morning before coating. Percents used are as follows:

0.1%=0.02 gm/20 gm Topcoat
0.2%=0.04 gm/20 gm Topcoat
0.3%=0.06 gm/20 gm Topcoat
0.4%=0.08 gm/20 gm Topcoat
0.5%=0.10 gm/20 gm Topcoat
0.6%=0.12 gm/20 gm Topcoat
1.2%=0.24 gm/20 gm Topcoat

| Silver Dispersion Formulation | | | | |
|---|---|---|---|---|
| Red Light | Premix Red Light | % | Grams Red Light | Mix Time Min |
| Half Soap homogenate | | 55.9660 | 195.88 gms | |
| B-76 (Polyvinyl butyral) | | 0.3114 | 1.09 gms | 15.0 |
| Zinc Bromide in | (10.00 gms) | 0.0857 | 3.00 mls | 15.0 |
| MeOH | (100.00 mls) | 0.6806 | | |
| Toluene | | 19.0457 | 76.60 mls | 15.0 |
| Pyridine in | (4.00 gms) | 0.0274 | 2.40 mls | 15.0 |
| MEK | (100.00 mls) | 0.5527 | | |
| Ripen Four Hours with Minimal Agitation | | | | |
| B-76 | | 9.0714 | 27.21 gms | 30.0 |
| NBS in | (1.33 gms) | 0.0104 | 2.73 mls | 60.0 |
| MEOH | (100.00 mls) | 0.6193 | | |
| Stop: Hold Over Night | | | | |
| CAO-5 | | 1.6000 | 4.80 gms | 5.0 |
| A-21 | | 7.7771 | 23.33 gms | 10.0 |
| 421 dye (spectral sensitizing dye) in | (0.117 gms) | 0.0011 | 3.30 mls | 5.0 |
| MEOH | (100.00 mls) | 0.7497 | | |
| 454 dye (spectral sensitizing dye) in | (0.157 gms) | 0.0022 | 5.17 mls | 10.0 |
| MeOH | (75.00 mls) | 0.9542 | | |
| Toluene | (25.00 mls) | 0.2386 | | |
| Acetone | (25.00 mls) | 0.3068 | 10.19 mls | |
| Total | | 100.0000 | 350.00 gms | |

1) Viscosity—200±20 cps. adjust with acetone
2) % solids—21.3%
3) Silver Trip—4.5 mils over paper. Dry 3 minutes at 185° F. (85° C.).
4) Silver coating weight—1.15±0.10 gm/ft$^2$.

The effects of the no mercury dry silver using these triazines was compared to a mercury-containing dry silver formulation. These HGR compounds were evaluated in the topcoat formulation. All representative data shown has been exposed to the EGG with P-31 filter and processed at 250° F. (120° C.) for 6 seconds.

| Mercury-Containing Specification (Sensitometric) - 6 sec/250° F. | | | | |
|---|---|---|---|---|
| D-Min | D-Max | Sp. Pt | Ergs | Gamma Angle |
| 0.16 max | 1.50 min | 0.90–1.28 | (8–9) | 57.0–70.0 |

Initial sensitometry and oven accelerated aging data: 6 sec/250° F.

| Mercury Formulation | D-Min | D-Max | Sp. Pt. | Ergs | Gamma Angle |
|---|---|---|---|---|---|
| Initial | 0.06 | 1.58 | 1.26 | 18 | 64.3 |
| 1 wk | 0.06 | 1.56 | 1.64 | 44 | 58.8 |
| 2 wk | 0.06 | 1.56 | 1.84 | 69 | 55.0 |
| 4 wk | 0.07 | 1.54 | 1.93 | 85 | 52.7 |

A topcoat was made leaving out the HGR compounds and coated on the zero mercury content silver trip.

| D-Min | D-Max | Sp. Pt. | Gamma Angle |
|---|---|---|---|
| 0.65 | 1.68 | 0.59 | 64.0 |

| Compound 1 | | | | | |
|---|---|---|---|---|---|
| | D-Min | D-Max | Sp. Pt. | Ergs | Gamma Angle |
| Compound 1 (0.20%) | | | | | |
| Initial | 0.11 | 1.68 | 0.91 | 8 | 69.7 |
| 1 wk | 0.10 | 1.66 | 0.95 | 9 | 69.3 |
| 2 wk | 0.11 | 1.65 | 0.97 | 9 | 66.8 |
| 3 wk | 0.14 | 1.62 | 1.01 | 10 | 63.7 |
| 4 wk | 0.22 | 1.65 | 0.97 | 9 | 60.2 |
| Compound 1 (0.40%) | | | | | |
| Initial | 0.10 | 1.64 | 1.04 | 11 | 66.2 |
| 1 wk | 0.08 | 1.56 | 1.22 | 17 | 63.0 |
| 2 wk | 0.08 | 1.54 | 1.33 | 21 | 60.6 |
| 3 wk | 0.07 | 1.51 | 1.60 | 40 | 53.7 |
| 4 wk | 0.07 | 1.50 | 1.84 | 69 | 51.3 |
| Compound 1 (0.50%) | | | | | |
| Initial | 0.09 | 1.66 | 1.04 | 11 | 66.7 |
| 1 wk | 0.08 | 1.58 | 1.21 | 16 | 63.7 |
| 2 wk | 0.08 | 1.57 | 1.28 | 19 | 62.2 |
| 3 wk | 0.07 | 1.49 | 1.70 | 50 | 52.7 |
| 4 wk | 0.07 | 1.46 | 2.16 | 144 | 48.0 |
| Compound 1 (0.60%) | | | | | |
| Initial | 0.11 | 1.65 | 1.06 | 11 | 62.7 |
| 1 wk | 0.08 | 1.55 | 1.32 | 21 | 61.0 |
| 2 wk | 0.07 | 1.53 | 1.44 | 27 | 58.8 |
| 3 wk | 0.07 | 1.46 | 1.90 | 79 | 53.5 |
| 4 wk | 0.09 | 1.44 | 2.32 | 209 | 48.8 |

| Compound 2 | | | | | |
|---|---|---|---|---|---|
| | D-Min | D-Max | Sp. Pt. | Ergs | Gamma Angle |
| Compound 2 (0.10%) | | | | | |
| Initial | 0.17 | 1.68 | 1.81 | 6 | 71.7 |
| 1 wk | 0.24 | 1.63 | 0.97 | 9 | 52.0 |
| 2 wk | 0.57 | 1.66 | 1.09 | 12 | 32.5 |
| 3 wk | 0.81 | 1.69 | 0.56 | — | 25.7 |
| 4 wk | | | | | |
| Compound 2 (0.30%) | | | | | |
| Initial | 0.12 | 1.69 | 0.85 | 7 | 70.9 |
| 1 wk | 0.10 | 1.65 | 0.91 | 8 | 69.6 |
| 2 wk | 0.10 | 1.61 | 0.92 | 8 | 67.5 |
| 3 wk | 0.11 | 1.60 | 0.86 | 7 | 64.2 |
| 4 wk | 0.21 | 1.62 | 0.88 | 8 | 56.7 |
| Compound 2 (0.40%) | | | | | |
| Initial | 0.11 | 1.67 | 0.89 | 8 | 69.9 |
| 1 wk | 0.10 | 1.63 | 0.96 | 9 | 68.5 |

-continued

| | D-Min | D-Max | Sp. Pt. | Ergs | Gamma Angle |
|---|---|---|---|---|---|
| | | Compound 2 | | | |
| 2 wk | 0.09 | 1.61 | 0.93 | 9 | 67.2 |
| 3 wk | 0.10 | 1.65 | 0.88 | 8 | 64.8 |
| 4 wk | 0.20 | 1.61 | 0.91 | 8 | 55.3 |
| | | Compound 2 (0.50%) | | | |
| Initial | 0.11 | 1.66 | 0.90 | 8 | 69.6 |
| 1 wk | 0.10 | 1.66 | 0.94 | 9 | 69.3 |
| 2 wk | 0.09 | 1.62 | 0.93 | 9 | 68.4 |
| 3 wk | 0.10 | 1.61 | 0.94 | 9 | 64.5 |
| 4 wk | 0.13 | 1.62 | 1.02 | 10 | 55.8 |
| | | Compound 2 (0.60%) | | | |
| Initial | 0.11 | 1.69 | 0.88 | 8 | 70.1 |
| 1 wk | 0.10 | 1.66 | 0.94 | 9 | 68.8 |
| 2 wk | 0.09 | 1.63 | 0.96 | 9 | 67.1 |
| 3 wk | 0.10 | 1.60 | 0.95 | 9 | 63.4 |
| 4 wk | 0.16 | 1.64 | 0.98 | 10 | 55.2 |

| | D-Min | D-Max | Sp. Pt. | Ergs | Gamma Angle |
|---|---|---|---|---|---|
| | | Compound 3 | | | |
| | | Compound 3 (0.10%) | | | |
| Initial | 0.20 | 1.66 | 0.80 | 6 | 71.0 |
| 1 wk | 0.18 | 1.66 | 0.84 | 7 | 69.4 |
| 2 wk | 0.16 | 1.66 | 0.84 | 7 | 66.3 |
| 3 wk | 0.27 | 1.64 | 0.80 | 6 | 57.6 |
| 4 wk | 0.65 | 1.68 | — | — | — |
| | | Compound 3 (0.30%) | | | |
| Initial | 0.12 | 1.70 | 0.87 | 7 | 70.9 |
| 1 wk | 0.11 | 1.63 | 0.95 | 9 | 68.9 |
| 2 wk | 0.09 | 1.62 | 0.95 | 9 | 67.1 |
| 3 wk | 0.10 | 1.61 | 0.90 | 8 | 63.6 |
| 4 wk | 0.19 | 1.61 | 0.91 | 8 | 55.5 |
| | | Compound 3 (0.40%) | | | |
| Initial | 0.12 | 1.68 | 0.88 | 8 | 70.2 |
| 1 wk | 0.10 | 1.66 | 0.93 | 9 | 69.5 |
| 2 wk | 0.09 | 1.61 | 0.95 | 9 | 66.7 |
| 3 wk | 0.10 | 1.60 | 0.94 | 9 | 64.2 |
| 4 wk | 0.15 | 1.60 | 0.94 | 9 | 58.2 |
| | | Compound 3 (0.50%) | | | |
| Initial | 0.12 | 1.68 | 0.90 | 8 | 69.5 |
| 1 wk | 0.09 | 1.63 | 1.03 | 11 | 67.1 |
| 2 wk | 0.08 | 1.63 | 0.97 | 9 | 66.7 |
| 3 wk | 0.09 | 1.61 | 0.96 | 9 | 63.2 |
| 4 wk | 0.13 | 1.63 | 0.99 | 10 | 56.2 |
| | | Compound 3 (0.60%) | | | |
| Initial | 0.11 | 1.69 | 0.90 | 8 | 70.0 |
| 1 wk | 0.10 | 1.66 | 0.95 | 9 | 68.3 |
| 2 wk | 0.09 | 1.66 | 0.95 | 9 | 67.5 |
| 3 wk | 0.10 | 1.62 | 0.96 | 9 | 65.0 |
| 4 wk | 0.12 | 1.64 | 0.94 | 9 | 61.5 |

| | D-Min | D-Max | Sp. Pt. | Ergs | Gamma Angle |
|---|---|---|---|---|---|
| | | Compound 4 | | | |
| | | Compound 4 (0.10%) | | | |
| Initial | 0.20 | 1.68 | 0.81 | 6 | 71.1 |
| 1 wk | 0.17 | 1.68 | 0.83 | 7 | 70.4 |
| 2 wk | 0.17 | 1.66 | 0.81 | 6 | 68.2 |
| 3 wk | 0.17 | 1.67 | 0.80 | 6 | 67.1 |
| 4 wk | 0.26 | 1.65 | 0.83 | 7 | 57.6 |
| | | Compound 4 (0.30%) | | | |
| Initial | 0.12 | 1.66 | 0.90 | 8 | 70.2 |
| 1 wk | 0.11 | 1.64 | 0.92 | 8 | 69.2 |
| 2 wk | 0.11 | 1.63 | 0.85 | 7 | 67.7 |
| 3 wk | 0.13 | 1.64 | 0.86 | 7 | 63.9 |
| 4 wk | 0.24 | 1.63 | 0.78 | — | 57.8 |
| | | Compound 4 (0.40%) | | | |
| Initial | 0.11 | 1.65 | 0.90 | 8 | 70.1 |
| 1 wk | 0.11 | 1.61 | 0.99 | 10 | 68.6 |
| 2 wk | 0.10 | 1.62 | 0.97 | 9 | 66.6 |
| 3 wk | 0.11 | 1.60 | 0.93 | 9 | 64.9 |
| 4 wk | 0.16 | 1.62 | 0.85 | 7 | 60.4 |

-continued

| | D-Min | D-Max | Sp. Pt. | Ergs | Gamma Angle |
|---|---|---|---|---|---|
| | | Compound 4 | | | |
| | | Compound 4 (0.50%) | | | |
| Initial | 0.11 | 1.66 | 0.90 | 8 | 70.3 |
| 1 wk | 0.11 | 1.63 | 0.94 | 9 | 68.5 |
| 2 wk | 0.11 | 1.62 | 0.97 | 9 | 66.2 |
| 3 wk | 0.10 | 1.62 | 0.96 | 9 | 64.6 |
| 4 wk | 0.15 | 1.62 | 0.88 | 8 | 60.2 |
| | | Compound 4 (0.60%) | | | |
| Initial | 0.11 | 1.66 | 0.94 | 9 | 69.3 |
| 1 wk | 0.10 | 1.63 | 0.98 | 10 | 68.1 |
| 2 wk | 0.09 | 1.65 | 0.93 | 9 | 68.4 |
| 3 wk | 0.10 | 1.63 | 0.95 | 9 | 64.9 |
| 4 wk | 0.15 | 1.67 | 0.86 | 7 | 63.0 |
| | | Compound 4 (1.2%) | | | |
| Initial | 0.10 | 1.60 | 0.93 | 9 | 69.1 |
| 1 wk | 0.10 | 1.60 | 1.01 | 10 | 67.1 |
| 2 wk | 0.09 | 1.56 | 1.02 | 10 | 65.2 |
| 3 wk | 0.10 | 1.57 | 0.98 | 10 | 62.9 |
| 4 wk | 0.14 | 1.59 | 0.96 | 9 | 58.9 |

| | D-Min | D-Max | Sp. Pt. | Ergs | Gamma Angle |
|---|---|---|---|---|---|
| | | Compound 5 | | | |
| | | Compound 5 (0.05%) | | | |
| Initial | 0.22 | 1.65 | 0.82 | 7 | 71.1 |
| 1 wk | 0.20 | 1.63 | 0.82 | 7 | 70.9 |
| 2 wk | 0.19 | 1.62 | 0.78 | 6 | 69.2 |
| 3 wk | 0.24 | — | — | — | — |
| 4 wk | 0.55 | 1.65 | 0.47 | — | 56.7 |
| | | Compound 5 (0.1%) | | | |
| Initial | 0.18 | 0.66 | 0.80 | 6 | 71.1 |
| 1 wk | 0.16 | 1.63 | 0.87 | 7 | 70.0 |
| 2 wk | 0.14 | 1.65 | 0.81 | 6 | 69.6 |
| 3 wk | 0.18 | 1.63 | 0.75 | 6 | 65.5 |
| 4 wk | 0.34 | 1.64 | 0.65 | — | 58.7 |
| | | Compound 5 (0.3%) | | | |
| Initial | 0.13 | 1.65 | 0.88 | 8 | 70.5 |
| 1 wk | 0.12 | 1.61 | 0.91 | 8 | 69.6 |
| 2 wk | 0.10 | 1.62 | 0.92 | 8 | 67.8 |
| 3 wk | 0.12 | 1.61 | 0.83 | 7 | 65.7 |
| 4 wk | 0.18 | 1.62 | 0.78 | — | 61.5 |
| | | Compound 5 (0.6%) | | | |
| Initial | 0.11 | 1.66 | 0.92 | 8 | 68.7 |
| 1 wk | 0.10 | 1.64 | 0.91 | 8 | 69.3 |
| 2 wk | 0.10 | 1.62 | 0.91 | 8 | 67.6 |
| 3 wk | 0.11 | 1.60 | 0.90 | 8 | 64.5 |
| 4 wk | 0.19 | 1.64 | 0.81 | — | 60.1 |

| | | ΔD-Min |
|---|---|---|
| Print Stability Data - Lightbox - 12 Hrs 1250 Footcandles Delta D-min Ranges of Samples Tested | | |
| | | +0.09–0.11 |
| Compound 1 | (Concentration Range) | +0.00–0.06 |
| Compound 2 | (Concentration Range) | +0.03–0.05 |
| Compound 3 | (Concentration Range) | +0.02–0.10 |
| Compound 4 | (Concentration Range) | +0.02–0.06 |
| Compound 4 | (Concentration Range) | +0.04–0.06 |
| Print Stability Data - Tabletop Lab Conditions | | |
| | 25 Days | +0.10 |
| Compound 1 | (Concentration Range) 4 wks | +0.01–0.05 |
| Compound 2 | No Tabletop Data | |
| Compound 3 | No Tabletop Data | |
| Compound 4 | (Concentration Range) 4 wks | +0.04–0.05 |
| Compound 4 | (Concentration Range) 4 wks | +0.03–0.04 |

What is claimed is:

1. A photothermographic emulsion comprising photosensitive silver halide, silver oxidizing agent, reducing agent for silver ion, and a binder, said emulsion further comprising a triazine represented by the formula

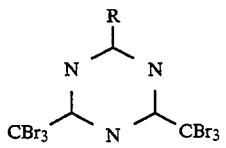

wherein R is —$NR^1R^2$ wherein $R^1$ and $R^2$ are selected from H, alkyl group of 1 to 20 carbon atoms, and aryl group of 1 to 20 carbon atoms, or $R^1$ and $R^2$ may be combined to form a heterocyclic ring group with the included nitrogen of —$NR^1R^2$.

2. The emulsion of claim 1 further comprising halogen molecules.

3. The emulsion of claim 1 wherein said silver oxidizing agent comprises the silver salt of an organic carboxylic acid.

4. The emulsion of claim 3 wherein said acid has from 14 to 28 carbon atoms.

5. The emulsion of claim 1 wherein bromine comprises at least thirty percent by weight of said triazine.

6. The emulsion of claim 4 wherein bromine comprises at least 40% by weight of said triazine.

7. The emulsion of claim 1 wherein R is selected from the group consisting of —NH-cyclohexyl groups and piperidino groups.

* * * * *

UNITED STATES PATENT AND TRADEMARK OFFICE

CERTIFICATE OF CORRECTION

PATENT NO. : 5,340,712

DATED : August 23, 1994

INVENTOR(S) : Susan H. Dunn, Mark P. Kirk, Roger A. Mader and Terence D. Spawn

It is certified that error appears in the above-indentified patent and that said Letters Patent is hereby corrected as shown below:

Col. 13, line 52, insert --Red Light-- as a heading above the columns "421 dye"; "(0.117 gms)" and "3.30 mls".

Col. 17, line 5,

" 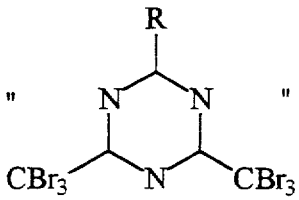 " should read -- 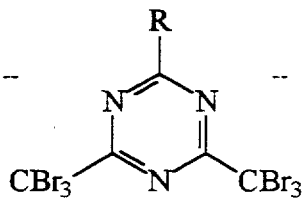 --

Signed and Sealed this

Fifth Day of September, 1995

*Attest:*

*Attesting Officer*

BRUCE LEHMAN

*Commissioner of Patents and Trademarks*